United States Patent [19]

Wen

[11] Patent Number: 4,615,712

[45] Date of Patent: Oct. 7, 1986

[54] FUEL AGGLOMERATES AND METHOD OF AGGLOMERATION

[75] Inventor: Wu-Wey Wen, Murrysville, Pa.

[73] Assignee: The United States of America as represented by the United States Department of Energy, Washington, D.C.

[21] Appl. No.: 764,277

[22] Filed: Aug. 9, 1985

[51] Int. Cl.[4] ..... C10L 5/00; C10L 5/10; C10L 5/02

[52] U.S. Cl. ..... 44/10 R; 44/15 R; 44/17

[58] Field of Search ..... 44/10 R, 15 R, 17

[56] References Cited

U.S. PATENT DOCUMENTS

| | | | |
|---|---|---|---|
| Re. 27,262 | 12/1971 | Schick et al. | 44/17 X |
| 1,452,992 | 4/1923 | Westrum | 44/1 T |
| 1,790,356 | 1/1931 | Smith | 44/1 T |
| 2,890,945 | 6/1959 | Dohmen | 44/15 R X |
| 3,955,937 | 5/1976 | Whang | 44/17 |
| 3,988,121 | 10/1976 | Leveskis | 44/17 X |
| 4,156,595 | 5/1979 | Scott et al. | 44/15 R X |
| 4,210,422 | 7/1980 | Titus | 44/15 R |
| 4,302,209 | 11/1981 | Baker et al. | 44/10 D |
| 4,395,265 | 7/1983 | Reilly et al. | 44/15 R |
| 4,412,840 | 11/1983 | Goksel | 44/10 D |

FOREIGN PATENT DOCUMENTS

| | | | |
|---|---|---|---|
| 8404534 | 11/1984 | World Int. Prop. O. | 44/10 R |
| 494770 | 11/1938 | United Kingdom | 44/17 |
| 566001 | 12/1944 | United Kingdom | 44/15 R |
| 150483 | 2/1961 | U.S.S.R. | 44/15 R |

OTHER PUBLICATIONS

Humic Acids From Leonardite, A Soil Conditioner and Organic Fertilizer, Youngs et al., Bureau of Mines, N. D. Academy of Sci., vol. 17, 1963.

Leonardite: A Material of Industrial Promise: Bureau of Mines, U. of N. D. Symposium, Apr. 1961; by Abbott.

Natural Weathering of Coal.; Ingram et al., UPI Blacksburg, VA, Oct. 1961, Fuel Mar. 1984, vol. 63.

Production of Acid Iron Ore Pellet From Direct Reduction Using an Organic Binder, Mining Engineering, 1984; Souza et al.

Hunic Acids From Coal, Friedman et al., PA, 8th col., Industrial and Engineering Chem. vol. 42, #52, 1950.

Leonardite and Other Materials as Drilling Fluid Dispersants and Viscosity Control Agents; Odenbaugh et al., U.S.D.I. #3043, Bureau of Mines, 1967.

Leonardite: A Lignite Byproduct; Fowker et al., U.S.-D.I. 1960 #5611, Bureau of Mines.

Transactions and Communications, Sept. 1938, J. of the Soc. of Chem. Industry, Morgan et al.

Humic Acid From Lignite, R. W. Youngs.

Development and Demonstration of Lignite; Boker et al., Mar. 1982, Pittsburgh Mining Technology Center Pitt. PA, U.S. Dept. of Energy.

Soc. of Mining Engineers of AIME; Mehrotra et al., Dept. of Materials Science and Mineral Engineering U. of Ca., Berkeley Ca. Feb. 1981, 22–26.

Pelletization of Coal Fires: State-of-the-Art, 3rd. International Symposium on Agglomeration; West Germany, 1981.

Iron Ore Pellet Binders from Lignite Deposites, Fine et al., #6564, U.S.D.I.B. of Mines, 1964.

*Primary Examiner*—Andrew H. Metz
*Assistant Examiner*—William G. Wright
*Attorney, Agent, or Firm*—Hugh W. Glenn; Robert J. Fisher; Judson R. Hightower

[57] ABSTRACT

Solid fuel agglomerates are prepared of particulate coal or other carbonaceous material with a binder having a high humic acid or humate salt content. The humic acid is extracted from oxidized carbonaceous material with a mild aqueous alkali solution of, for instance, ammonia. The particulate material is blended with the extract which serves as the binder for the agglomerates. The water-resistant agglomerates are formed such as by pelletizing, followed by drying to remove moisture and solidify the humic acid binder throughout the agglomerate.

15 Claims, 1 Drawing Figure

FUEL AGGLOMERATES AND METHOD OF AGGLOMERATION

CONTRACTUAL ORIGIN OF THE INVENTION

The U.S. Government has rights in this invention pursuant to the employer-employee relationship of the U.S. Department of Energy and the inventor.

BACKGROUND OF THE INVENTION

This invention relates to a method of agglomerating carbonaceous material such as coal for use as fuel and to the fuel agglomerates made by this method. In particular, the invention relates to the use of an extract from coal or other materials of botanical origin as a binder for the fuel agglomerates.

There has been a long-felt need for a suitable inexpensive binder to consolidate the various coal and coal-related materials into weather-resistant agglomerates of convenient size for fuel use. Modern coal mining and coal cleaning techniques are generating increasing quantities of degraded coal materials. Coal preparation plants produce large quantities of fine size clean coal and refuse with high water or moisture content. The further use of such materials involves serious handling problems. Wet material can freeze in winter to form large masses that must be thawed or broken before handling and refuse fines are a significant environmental problem. With fine dry material, heavy dust losses and air contamination result, in addition to an unwarranted waste of an energy resource.

More stringent power plant emission standards and the increased interest in the use of coal slurries may result in an even greater amount of coal fine production in the future. Finer grinding may be required to liberate undesirable ash and sulfur impurities from coal prior to beneficiation and final utilization.

A parallel set of problems arise with low-rank coals such as lignite. Vast lignite deposits, often low in sulfur content, can be easily and inexpensively mined. Unfortunately, the use of lignite has been restricted generally to the immediate area of the deposits because of its high inherent moisture content and resultant lower Btu content. Its tendencies to degrade in particle size during handling and to spontaneous combust further restrict its use.

For more than half a century, these problems have been addressed, with attempts to provide fuel particles of convenient size and stable structure. For example, U.S. Pat. Nos. 1,452,992 (1923) and 1,790,356 (1929) disclose briquetting processes with asphalt, tar, pitch, etc. as binder to effect consolidating of fine coals or petroleum derived materials.

In more recent efforts, lignite pellets have been formed with asphalt emulsion or other emulsified binder materials. These processes are illustrated in U.S. Pat. Nos. 4,302,209 and 4,412,840, awarded to Baker et al and Goksel respectively. Although satisfactory pellets are formed, the cost of providing and applying the asphalt emulsion offsets the economic value of the process.

Therefore, it is an object of the present invention to provide an economic process for agglomerating particulate carbonaceous fuel.

It is a further object to provide a method for agglomerating coal particulates which uses an inexpensive coal extract as binder material.

It is also an object to provide a process for producing fuel agglomerates of convenient size with good stability to permit handling and exposure to weather during the course of fuel distribution.

It is a further object to provide a weather resistent fuel agglomerate of good mechanical properties.

In accordance with the present invention, there is provided a method of producing weather resistent carbonaceous agglomerates suitable for fuel use. A carbonaceous material that includes chemically combined oxygen as humic acid or humate salt is treated with an aqueous alkali solution to extract humates and thereby provide a binder liquid. A particulate carbonaceous fuel with a substantially greater heating value than the humic acid containing material is blended with the binder liquid to permeate the humate solute into the fuel particulates. The particulates, as thus treated with binder, are formed into agglomerates and dried to reduce moisture content and convert the humate solute to a water-resistent binder material.

In more specific aspects of the invention, the humic acid containing carbonaceous material is formed by the mild oxidation of a coal-derived material such as leonardite, peat, soil or decayed botanical residue. The carbonaceous material includes carbon and oxygen on a weight ratio of no more than six to one on a moisture-free basis.

In further more specific aspects, the humates are extracted from the oxidized carbonaceous material into an aqueous alkali solution selected from solutions of alkali metal hydroxides, alkali metal carbonates, or ammonia.

In other aspects, the agglomerates are dried in air at a temperature of about 100°–200° C. sufficient to reduce moisture content to less than 15% by weight and solidify the humates into a binder permeated into the fuel particulates throughout the agglomerates.

In yet other aspects of the invention, a weather resistant fuel agglomerate of suitable size, shape and mechanical strength for conveyance and handling is provided. The agglomerate includes carbonaceous fuel particles bound together by a humate constituent permeated into and combined with surface portions of the carbonaceous particles making up the agglomerate. In more specific aspects, the agglomerate comprises by weight about 60–90% coal particles, 0–25% moisture and 1–10% humate constituent.

BRIEF DESCRIPTION OF THE DRAWING

The present invention is illustrated in the accompanying drawing which is a flow diagram of a coal particle agglomeration process.

DETAILED DESCRIPTION OF THE PREFERRED EMBODIMENT

Figure 1:
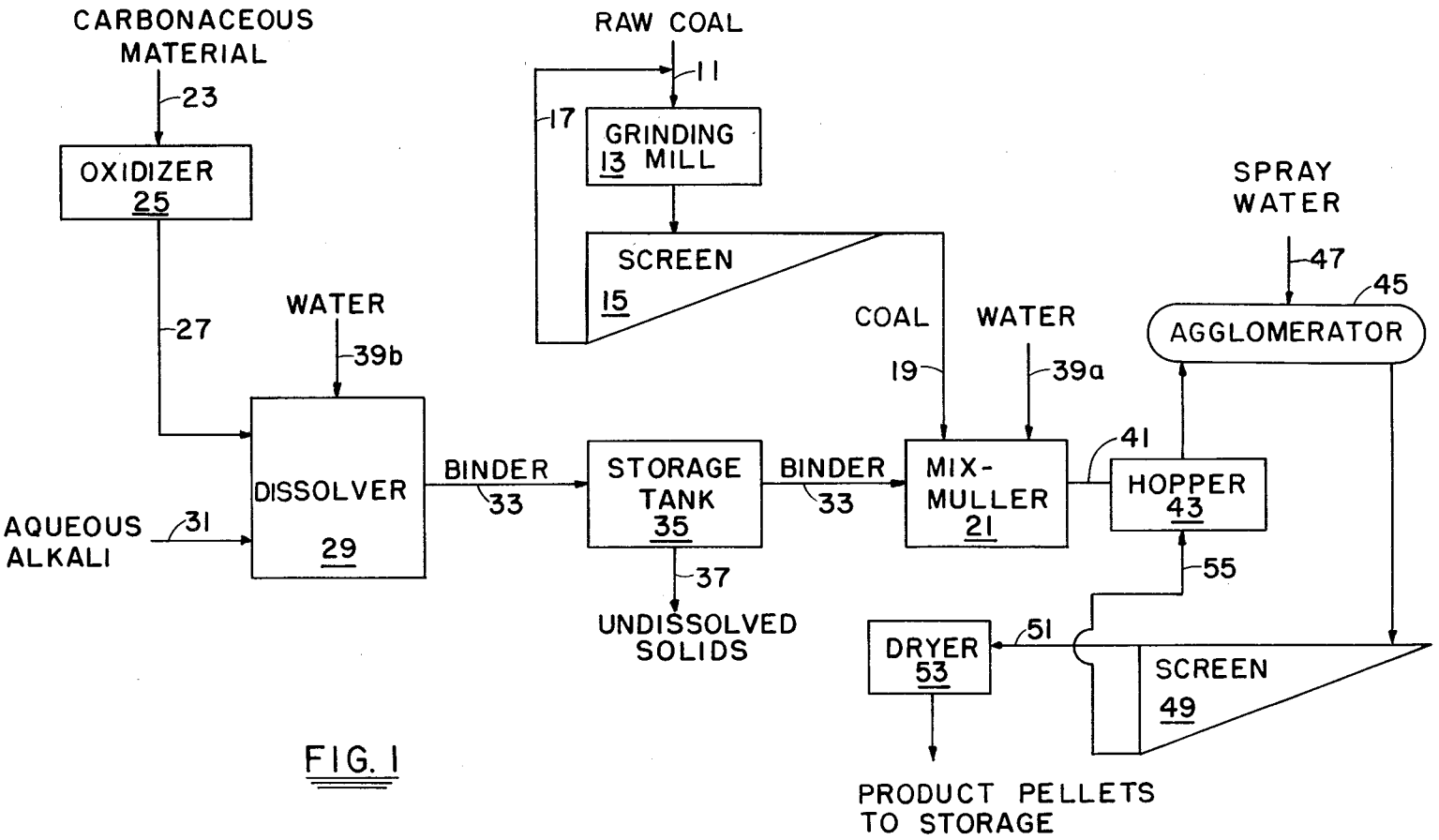

The present process is conveniently described in reference to the FIGURE. Raw coal or other carbonaceous material 11 is crushed and ground in a suitable mill 13 and screened to separate suitably small particulates for agglomeration into fuel particles, typically particles of 500 um or less are contemplated for agglomeration. Larger sizes 17 can be recycled for further size reduction.

The carbonaceous material selected for processing ordinarily will be one that exhibits poor mechanical properties, has a high moisture content or is otherwise less than fully suitable for use as a solid fuel. Lignite coal, although having substantial fuel value and relatively low sulfur content crumbles easily and may freeze on winter exposure due to high moisture content, e.g. 10–40%. Bituminous coal and fines generated in coal mining, handling and cleaning processes may be rendered into a useful fuel form by the presently described agglomeration process. Any of such particulate carbonaceous materials represented at 19 are sent to a mix-muller 21 for blending with a binder 33.

Both lignite and sub-bituminous coal contain higher levels of moisture than bituminous coal. As portions of this higher moisture content may be trapped in the pores and structure of the coal, pellets of lignite and sub-bituminous coal are advantageously dried to a lesser extent than the pellets of bituminous coal fines. As will be illustrated below, the retention of a major portion of the trapped moisture content enhances the mechanical properties of lignite and subbituminous coal pellets.

The binder 33 also is derived from a coal or other carbonaceous material, as illustrated at 23. This coal can be of lower grade and heating value than the raw coal 11 selected for consolidation into fuel agglomerates. It is only required that this carbonaceous material 23 be of botanical origin such that it can be oxidized as at 25 to form humic acid. In some instances, the oxidation can occur naturally, for example, a naturally oxidized lignite, or leonardite can be selected and introduced for forming the binder. In other instances, a low-rank coal, coal slack, peat, soil or other carbonaceous material of decayed plant origin can be selected and oxidized to provide a sufficient quantity of humic acid for forming the binder.

In oxidizer 25 the carbonaceous material is contacted with oxidizing agents such as hydrogen peroxide, sulfuric acid, nitric acid, potassium permanganate or potassium dichromate. Alternatively, the material can be oxidized by exposure to air and water as is the naturally oxidized leonardite. Increased temperature and pressure may be used to advance the oxidation rate. Likewise, a carbonaceous material of small particle size and large surface area is advantageously selected to increase contact with the oxidant.

The oxidized carbonaceous material 27 is transferred to a dissolver vessel 29 where it is treated by mixing and reacting with an aqueous alkali solution 31. The separate mixing and humic extraction step at 29 prior to contact with the much larger quantities of carbonaceous material is necessary to extract sufficient humate solute from the oxidized carbonaceous material. The dissolution can be performed advantageously at elevated temperatures of about 60°–300° C. to accelerate the reaction rate.

Various aqueous alkaline solutions 31 can be selected for humate extraction and dissolution. Although hydroxides and carbonates of the alkali metals and alkaline earth metals in solution can be used, an alkaline substance that subsequently can be separated from the fuel agglomerates during the drying step is preferred. Ammonia in solution is especially well suited for extracting the humate solutes and forming the binder because it can be driven off in the drying step.

The binder solution 33 is characterized as an aqueous solution of humates extracted from the oxidized carbonaceous material. The humates are derived from the humic acid resulting from oxidation of carbonaceous material of botanical origin. As stated, such materials include coal, peat, soil or decayed plant material - leonardite and other oxidized coal materials can include as much as 50–90% by weight humic acid with the remainder being mineral matter or unoxidized carbonaceous material.

Due to the prior oxidation and other degradation of these carbonaceous materials, these humate-containing materials will have a heating value substantially less than that of even low-rank coals such as lignite. Consequently, their use to form the present binder materials is of considerable advantage since materials such as leonardite are otherwise very poor fuel materials. As an example, dry leonardite may have a heating value of no more than 9,000 BTU/pound while even a low-rank lignite coal may have a heating value in excess of 10,000 BTU/pound on a moisture-free basis. Therefore, one other important advantage of this invention is that the binder can be made from material with a substantially lower heating value than the particulate fuel material. In acting on this advantage, the binder will be derived from an oxidized carbonaceous material 27 of botanical origin having a heating value of less than about 10,000 BTU/pound and the fuel particulate will be a carbonaceous material 11 such as coal having a heating value in excess of about 10,000 BTU/pound on a moisture-free basis.

The binder 33 can be stored in tank 35 maintaining a temperature range from 60° to 90° C. for proper viscosity until ready for use. Undissolved solids can be allowed to settle and be withdrawn at 37. If such solids include substantial undissolved carbonaceous material, they can be forwarded to the mix-muller 21 with the binder. Otherwise, solids 37 when high in mineral matter, are removed from the process to lower the ash content of the fuel agglomerates. However, the binder typically will comprise less than 10% of the fuel agglomerates and accordingly will add insignificant quantities of mineral matter to the process product.

Mix muller 21 typically is a pug mill or other suitable mixing apparatus for thoroughly blending the binder 33 with the particulate coal 19 and water. Where a pelletizing step is to be used for agglomerating the fuel particles, about 10–20% water based on the mixture 41 weight is used. This quantity of water is mostly added into the mix-muller 21, at 39A but may also include amounts needed in forming the binder added at 39B into dissolver 29. Where briquetting is to be used to consolidate the particulates by pressure, the amount of water should be minimized and be substantially less than that noted above.

The mixture 41 for agglomeration can be accumulated in hopper 43 for feeding into the agglomerator 45. Known devices such as a disk pelletizer or briquetting press are preferred for use, but other devices such as those used for extrusion and liquid phase agglomeration may be used. In the pelletizing operation, additional water as a spray 47 is required on the pellets as they are rolled on the disk surface. The agglomerates are separated by size on screen 49 with those of suitable size, e.g., 2 cm diameter and larger passing as green pellets 51 to dryer 53 and the finer agglomerates 55 returned to the hopper 43 or mix-muller 21.

The drying step is of particular importance. Not only is sufficient moisture removed to enhance the net heating value of the fuel, but the binder is solidified to firmly bind the particulates into the fuel agglomerate. The aqueous alkaline solution with humate solute is permeated into surface portions of the particulates and solidifies during drying to become an integral part of the agglomerate structure. Possibly some type of polymerization with the coal constituents occurs to strengthen the agglomerates. Where the alkali is ammonia, it can be driven off in the drying process so as not to add to the mineral ash content. Furthermore, removal of the alkali favors the solid gel-like humic acid in the agglomerate to enhance structural integrity. The inventor has found that drying should be conducted in a furnace with air atmosphere at about 100°-200° C. for about one half to three hours, depending on agglomerate size and hot air flow. Preferably, temperatures of 150°-170° C. are selected. These conditions are found sufficient to reduce moisture content, to enhance the water disintegration property of the agglomerate and to set the binder as an integral part of the agglomerate structure. For agglomerates of bituminous or other low-moisture coals, moisture contents of less than 10% are preferred. In the case of lignite or sub-bituminous coals, the agglomerates may require moisture levels up to 15% by weight to achieve good mechanical properties.

The following examples are presented to illustrate the invention.

EXAMPLE I

Leonardite of the analysis shown in Table I of less than 75 microns particle size was mixed in a composition of 69.4% water, 27.6% leonardite and 3% ammonia for about sixty minutes at 90° C. More than 60% of the leonardite was dissolved as humate solute forming the binder. A mixture for use in pelletizing was prepared in a mix-muller with about 4% binder, based on original leonardite; 16% water; and 80% bituminous coal of less than 500 microns particle size. Table II gives the analysis of the coal. The mixture was pelletized on a small disk pelletizer at 46° tilt at 14 rpm. Pellets larger than 1.5 cm were selected for drying in an oven at about 160° C. for two hours. The product pellets were found to have compressive strengths of 20-30 pounds, impact strengths of 25-45 drops and an abrasion resistance of over 95%. Significantly, the pellets remained intact after submersion for over 24 hours in water.

TABLE I

Leonardite Analysis
North Dakota Source

| | Coal (As Rec'd) | Coal (Moist Free) | Coal (Moist Ash Free) |
|---|---|---|---|
| Proximate Analysis | | | |
| Moisture | 12.41 | N/A | N/A |
| Volatile Matter | 42.78 | 48.84 | 56.89 |
| Fixed Carbon | 32.43 | 37.02 | 43.11 |
| Ash | 12.38 | 14.14 | N/A |
| Ultimate Analysis | | | |
| Hydrogen | 4.51 | 3.58 | 4.16 |
| Carbon | 50.04 | 57.13 | 66.53 |
| Nitrogen | .90 | 1.02 | 1.19 |
| Sulfur | 1.16 | 1.32 | 1.54 |
| Oxygen | 31.01 | 22.81 | 26.57 |
| Ash | 12.38 | 14.14 | N/A |
| Heating Value (BTU/LB) | 7,910 | 9,030 | 10,517 |

| Major Elements in Ash | |
|---|---|
| $SiO_2$ | 29.22 |
| $Al_2O_3$ | 10.75 |
| $Fe_2O_3$ | 9.23 |
| $TiO_2$ | .56 |
| CaO | 19.88 |
| MgO | 7.37 |
| $Na_2O$ | 1.72 |
| $K_2O$ | .84 |
| Sulfites | 19.21 |

TABLE II

Bituminous Coal Analysis
Pittsburgh Seam - Bruceton Mine, Pennsylvania

| | Coal (As Rec'd) | Coal (Moist Free) | Coal (Moist Ash Free) |
|---|---|---|---|
| Proximate Analysis | | | |
| Moisture | 1.96 | N/A | N/A |
| Volatile Matter | 36.45 | 37.2 | 40.3 |
| Fixed Carbon | 54.04 | 55.1 | 59.7 |
| Ash | 7.55 | 7.7 | N/A |
| Ultimate Analysis | | | |
| Hydrogen | 5.23 | 5.11 | 5.54 |
| Carbon | 75.12 | 76.63 | 83.02 |
| Nitrogen | 1.69 | 1.72 | 1.86 |
| Sulfur | 1.08 | 1.10 | 1.19 |
| Oxygen | 9.33 | 7.74 | 8.39 |
| Ash | 7.55 | 7.70 | N/A |
| Heating Value (Btu/LB) | 13,400 | 13,668 | 14,808 |

| Major Elements in Ash | |
|---|---|
| $SiO_2$ | 53.31 |
| $Al_2O_3$ | 25.99 |
| $Fe_2O_3$ | 9.45 |
| $TiO_2$ | 1.09 |
| CaO | 3.36 |
| MgO | 1.01 |
| $Na_2O$ | .57 |
| $K_2O$ | 1.34 |
| Sulfites | 2.93 |

EXAMPLE II

To illustrate that the humic acid binder can be obtained from various sources, bituminous and lignite coals were oxidized by exposure to oven temperatures of 40°-200° C. in air for several weeks. The oxidized samples along with separate samples of lignite and leonardite were dissolved in an aqueous sodium hydroxide solution of about one molar and the residual solids separated by centrifugal force. The soluble fraction is shown in Table III below as measured Humic acid.

TABLE III

| | Humic Acid Content of Various Coals | | |
|---|---|---|---|
| Coal | Measured Humic Acid (%) | Moisture (%) | Humic Acid Moisture-Free Basis (%) |
| Sub-bituminous coal | 8 | 25 | 11 |
| Lignite | 23 | 5* | 24 |
| Oxidized Lignite | 42 | 0 | 42 |
| Leonardite | 66 | 14 | 77 |
| Oxidized Bituminous Coal | 91 | 0 | 91 |

*Atmospheric temperature dried sample.

EXAMPLE III

Particulate lignite coal was pelletized by substantially the same procedures and using the same binder as in Example I. Drying was conducted at temperatures of 100°-105° C. and at about 160° C. for various periods of ½ to 3 hours. The analysis of the lignite and the properties of the resulting pellets are given in Tables IV and V below. As in Example I, the pellets were immersed in water for over 24 hours to determine disintegration rate and tested as in Example I for impact and compression strength.

TABLE IV

| North Dakota Lignite Analysis | Coal (As Rec'd) | Coal (Moist Free) | Coal (Moist, Ash Free) |
|---|---|---|---|
| Proximate Analysis | | | |
| Moisture | 14.28 | N/A | N/A |
| Volatile Matter | 35.98 | 41.97 | 46.98 |
| Fixed Carbon | 40.61 | 47.38 | 53.02 |
| Ash | 9.13 | 10.65 | N/A |
| Ultimate Analysis | | | |
| Hydrogen | 5.41 | 4.46 | 4.99 |
| Carbon | 54.52 | 63.60 | 71.18 |
| Nitrogen | .63 | .73 | .82 |
| Sulfur | 1.06 | 1.24 | 1.38 |
| Oxygen | 29.25 | 19.31 | 21.62 |
| Ash | 9.13 | 10.65 | N/A |
| Heating Value (BTU/LB) | 9,030 | 10,534 | 11,790 |
| Sulfur Forms | | | |
| Sulfite | .03 | .03 | .04 |
| Pyritic | .42 | .49 | .55 |
| Organic | .61 | .71 | .80 |

TABLE V

| Physical Properties of Lignite Coal Pellets | | | | |
|---|---|---|---|---|
| Drying Temperature - T = 105° C. | | | | |
| Time (hrs.) | 1 | 2 | 3 | |
| Moisture Loss (%) | 29.5 | 39.9 | 43.1 | |
| Compression Strength (lbs.) | 16.2 | 7.6 | 5.6 | |
| Impact Strength (drops) | 30.4 | 5.6 | 1.8 | |
| Water Disintegration Rate (%) | 100 | 100 | 100 | |
| Drying Temperature - T = 160° C. | | | | |
| Time (hrs.) | ½ | 1 | 1½ | 2 |
| Moisture Loss (%) | 28.66 | 38.0 | 42.0 | 50.0 |
| Compression Strength (lbs.) | 11.6 | 10.8 | 3 | cracked |
| Impact Strength (drops) | 18.6 | 3 | 1.4 | cracked |
| Water Disintegration Rate (%) | 33.1 | 22.7 | 0 | 0 |

EXAMPLE IV

In a manner similar to that of Examples I and III, pellets of sub-bituminous coal were prepared and tested. The analysis of the coal and pellet properties are given in Tables VI and VII below.

TABLE VI

| Sub-bituminous Coal Analysis Rosebud Seam - Rosebud Strip, Montana | Coal (As Rec'd) | Coal (Moist Free) | Coal (Moist, Ash Free) |
|---|---|---|---|
| Proximate Analysis | | | |
| Moisture | 20.8 | N/A | N/A |
| Volatile Matter (Mod) | 30.6 | 38.7 | 42.7 |
| Fixed Carbon | 41.2 | 52.0 | 57.3 |
| Ash | 7.4 | 9.3 | N/A |
| Ultimate Analysis | | | |
| Hydrogen | 5.9 | 4.5 | 4.9 |
| Carbon | 54.3 | 68.7 | 75.7 |
| Nitrogen | 0.7 | 0.9 | 1.0 |
| Sulfur | 0.7 | 0.9 | 1.0 |
| Oxygen | 31.0 | 15.7 | 17.4 |
| Ash | 7.4 | 9.3 | N/A |
| Heating Value (BTU/LB) | 9,160 | 11,540 | 12,730 |

TABLE VII

| Physical Properties of Sub-bituminous Coal Pellets | | | |
|---|---|---|---|
| Drying Temperature - T = 90° C. | | | |
| Time (hrs.) | 1 | 2 | 3 |
| Moisture Loss (%) | 29.39 | 30.80 | 31.0 |
| Compression Strength (lbs.) | 5 | 3 | 3 |
| Impact Strength (drops) | 2.4 | 3.4 | 3 |
| Water Disintegration Rate (%) | 100 | 100 | 100 |
| Drying Temperature - T = 160° C. | | | |
| Time (hrs.) | ½ | 1 | 1½ |
| Moisture Loss (%) | 21.35 | 35.65 | 39.9 |
| Compression Strength (lbs.) | 5.25 | 2.05 | 2.2 |
| Impact Strength (drops) | 6.8 | 1.5 | 1.2 |
| Water Disintegration Rate (%) | 69.5 | 88.7 | 5.77 |

It is therefore seen that the present invention provides a method of producing water-resistant carbonaceous agglomerates of a wide variety of particulate coals and other carbonaceous materials. A new binder material is used, which binder is obtained from oxidized carbonaceous material such as oxidized coals or leonardite. A substantial economic advantage is obtained by employing this readily available source for producing a humic acid binder. The pellets thus prepared are found to have good water resistance and acceptable mechanical properties.

Although the present invention is described in terms of specific materials and process steps, it will be clear to one skilled in the art that various changes and modifications may be made in accord with the inventions defined in the accompanying claims.

The embodiment of the invention in which an exclusive property of privilege is claimed is defined as follows:

1. A method of producing water-resistant carbonaceous agglomerates suitable for use as a fuel comprising:

providing a solid, oxidized carbonaceous material including chemically combined oxygen as humic acid or a humate salt;

extracting humates from the oxidized material into aqueous alkali solution to form a binder solution;

providing particulate carbonaceous fuel material having a heating value greater than that of the oxidized carbonaceous material;

blending the binder solution in mixture with the particulate fuel to permeate the humate solute into the fuel particles;

consolidating the particulate fuel into agglomerates of convenient size for fuel use; and drying the agglomerates to reduce moisture content and convert the humate solute into a solid, water-resistent binder material throughout the agglomerate.

2. The method of claim 1, wherein the oxidized carbonaceous material is provided by exposing coal to an aqueous solution including an oxidizing agent selected from the group consisting of hydrogen peroxide, sulfuric acid, nitric acid, potassium permanganate and potassium dichromate.

3. The method of claim 1, wherein said oxidized carbonaceous material is selected from the group of oxidized carbonacous material consisting of low-rank coal, leonardite, coal-derived material, peat, soil and decayed plant materials.

4. The method of claim 1, wherein said oxidized carbonaceous material includes oxygen to carbon in a weight ratio of at least 1 to 6 on, a moisture-free basis.

5. The method of claim 1, wherein humate salts are extracted from the oxidized carbonaceous material into an aqueous alkali solution selected from the group of aqueous alkali solutions consisting of in solution alkali metal hydroxides, alkaline earth metal hydroxides and ammonia hydroxide.

6. The method of claim 1, wherein said aqueous alkali solution includes ammonia.

7. The method of claim 6, wherein the binder is formed by extracting humate salts in a mixture comprising by weight about 60–80% water, 20–30% oxidized carbonaceous material and 2–4% ammonia at a temperature of about 80°–100° C. and wherein substantially all of the oxidized carbonaceous material and 2–4% ammonia at a temperature of about 80°–100° C. and wherein substantially all of the oxidized carbonacous material is provided with particle sizes of less than 150 microns.

8. The method of claim 1, wherein said agglomerates are formed on a pelletizing disk and dried to a water content of less than about 10%, sufficient to harden the binder and produce water-repellent pellets.

9. The method of claim 8, wherein said drying is conducted by passing hot air at 100°–200° C. over the pellets.

10. The method of claim 8, wherein the pellets are dried to a sufficiently low-moisture content to solidify the binder and form a water-resistent pellet.

11. The method of claim 1, wherein the binder is prepared from leonardite having a heating value of less than 10,000 BTU/pound and a fixed carbon to volatile matter ratio of less than one, on an as-received-basis.

12. The method of claim 1, wherein the agglomerates are formed by briquetting or extrusion of a thick aqueous slurry of particulate fuel.

13. The method of claim 6, wherein said solid agglomerates are dried at a sufficient temperature to volatize ammonia and leave solidified humic acid as waterproof binder permeated throughout the agglomerates.

14. A water-resistant fuel agglomerate comprising particulate carbonaceous fuel bound by a humic acid or humate constituent binder permeated throughout the agglomerate.

15. The water-resistant fuel agglomerate of claim 14, wherein the particulate fuel comprises about 2–25% moisture, 1–10% humic acid, and 60–90% agglomerated coal particles.

* * * * *